United States Patent [19]

Pickard

[11] 4,068,504

[45] Jan. 17, 1978

[54] BICYCLE LOCK

[75] Inventor: Frank W. Pickard, Inglewood, Calif.

[73] Assignee: Eleanor D. J. Stanford, Inglewood, Calif. ; a part interest

[21] Appl. No.: 708,748

[22] Filed: July 26, 1976

[51] Int. Cl.[2] ..... E05B 73/00

[52] U.S. Cl. ..... 70/18; 70/14; 70/22

[58] Field of Search ..... 70/14, 15–19, 70/23, 32–34, 181, 225–227, 233, 236; 292/267, 305

[56] References Cited

U.S. PATENT DOCUMENTS

| | | | |
|---|---|---|---|
| 1,472,155 | 10/1923 | Chapman | 70/18 |
| 3,855,825 | 12/1974 | Pickard | 70/14 |

*Primary Examiner*—Robert L. Wolfe

[57] ABSTRACT

A lock having a pair of jaws and a connecting shaft therebetween turnable in a first direction in response to a locking action of a key to cause the jaws to move inwardly and tightly grip against a spoked wheel rim or frame member of a bicycle and releasable only upon an unlocking action of the key to turn the shaft in an opposite direction. A cable may be connected between the jaws to allow the bicycle to be secured to a stationary object.

8 Claims, 5 Drawing Figures

FIG. 1
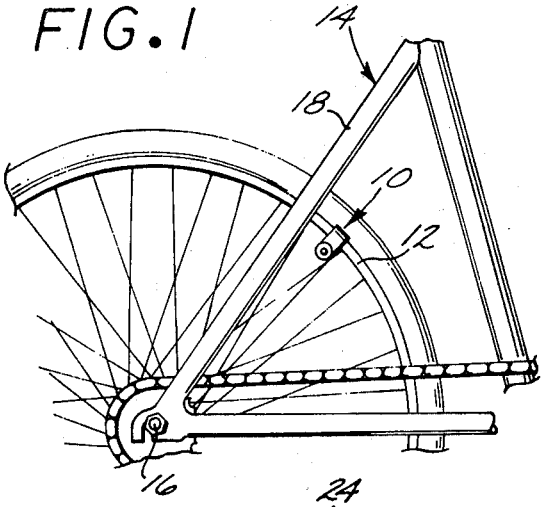
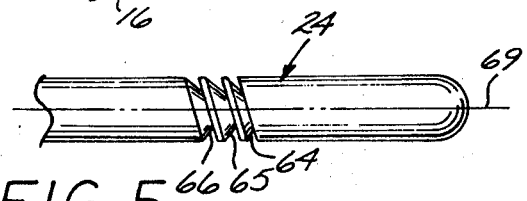
FIG. 5
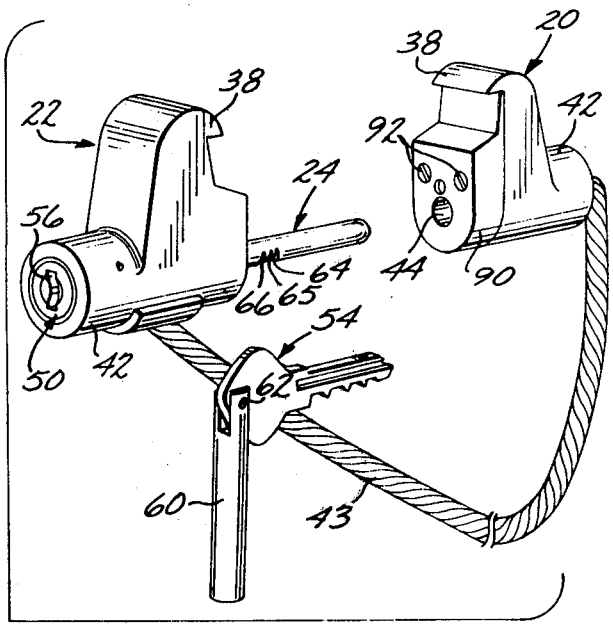
FIG. 2
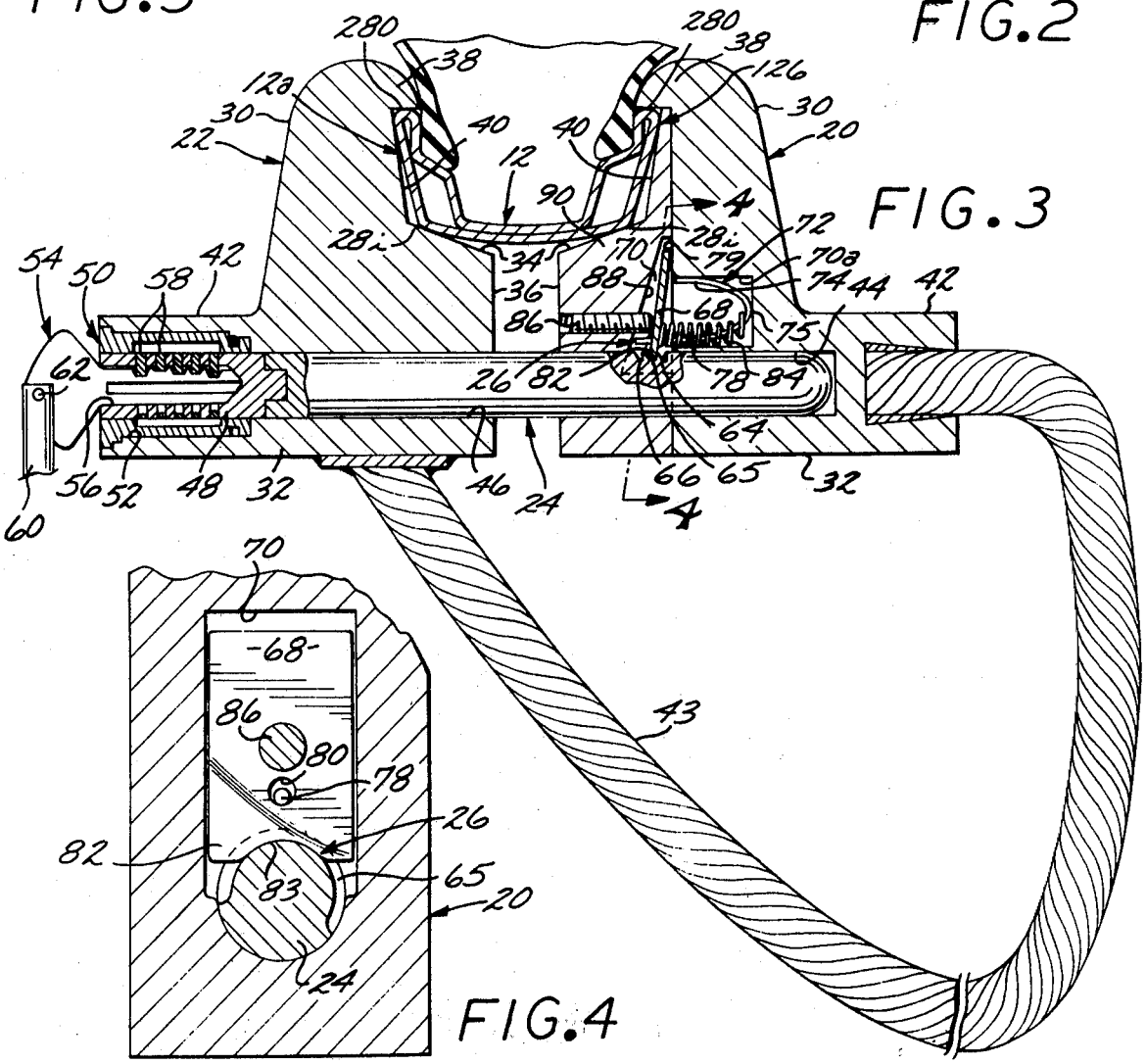
FIG. 3
FIG. 4

BICYCLE LOCK

BACKGROUND OF INVENTION

My present invention comprises an improvement upon the bicycle lock discribed in my prior U.S. Pat. No. 3,855,825 issued Dec. 24, 1974.

SUMMARY OF INVENTION

My present invention comprises a rattle-free, quick-release bicycle lock including a pair of jaws for gripping opposite sides of a rim of a spoked wheel in a direction generally parallel to an axle of the wheel. At least one of the jaws supports a projection for engaging a fork-like frame member supporting the axle when the jaws are affixed in place on the rim to limit rotation of the wheel. The jaws include coaxial holes for receiving a connecting shaft. The shaft is turnable in the coaxial holes, is axially fixed relative to one of the jaws, and is axially slidable in the hole in a movable one of the jaws. Cooperative means on the movable jaw and connecting shaft drive the movable jaw toward the fixed one of the jaws and releasably lock the movable jaw against axial movement on the shaft away from the fixed jaw as the shaft is turned to a preselected rotational position relative to the mavable jaw.

BRIEF DESCRIPTION OF THE DRAWINGS

FIG. 1 is a partial side view of the rear wheel and supporting structural frame members of a bicycle showing the quick release lock of my present invention in its locked position on the innermost periphery of the wheel rim.

FIG. 2 is a perspective view of my lock showing its component parts and a key for actuating the lock.

FIG. 3 is a sectional side view of the lock in a locked position on the rim of a bicycle wheel.

FIG. 4 is a sectional view taken along the line 4—4 in FIG. 3.

FIG. 5 is a fragmentary top view of an end portion of the connecting shaft included in my lock.

DESCRIPTION OF PREFERRED EMBODIMENT

In brief, the lock 10 of my present invention is designed to quickly and tightly clamp onto the spoked wheel rim 12 of a bicycle 14 and to limit rotation of the wheel on a axle 16 by engaging wheel supporting fork members 18 of the bicycle frame. To accomplish this, the illustrated form of the lock basically comprises a pair of jaws 20 and 22 supported on a turnable connecting shaft 24. The jaw 20 is axially movable on the shaft toward the jaw 22 to tightly grip between the jaws opposite sides 12*a* and 12*b* of the wheel rim. Thus positioned, the jaws are adapted to engage the fork members 18 and to thereby limit rotation of the bicycle wheel. Further, when the jaws 20 and 22 are moved axially against the rim 12, cooperative means 26 on the shaft and movable jaw is actuated by a turning of the shaft to a preselected rotational position to force the jaw 20 toward the jaw 22 to clamp the rim therebetween and to releasably lock the jaws against axial separation. A turning of the shaft 24 from the preselected rotational position, however, simply and quickly releases the cooperative means 26 permitting separation of the jaws and release of the lock from the wheel rim. Accordingly, the lock of my present invention is easily and effectively applied to and released from spoked bicycle wheels and the like and may be similarly clamped to other structural support members of the bicycle for convenient rattle-free storage when not in use.

Referring now more specifically to the preferred form of my invention illustrated in the drawing, the jaws 20 and 22 are of similar construction and are designed to capture and wedge tightly against the opposite sides 12*a* and 12*b* of the rim 12. In that respect, and as shown most clearly in FIG. 3, the rim 12 is generally U-shaped in cross section including annular outermost and innermost peripheral edges 28*o* and 28*i* on opposite sides thereof and the jaws are designed to grip the outermost edges and wedge against the innermost edges. To accomplish this, the jaws 20 and 22 include upward projections 30 from main body portions 32 of the jaws. The projections 30 include opposing upwardly and ouwardly sloping surfaces 34 extending from generally vertical end surfaces 36 of the main body portions, and inwardly directed substantially horizontal opposing lips 38 connected to the sloping surfaces by vertically extending surfaces 40. As represented in FIG. 3, the lips engage the opposite outermost peripheral edges 280 while the opposing sloping surfaces 34 engage the opposite innermost peripheral edges 28*i* to exert wedging forces on the rim 12 as the jaws 20 and 22 are moved axially toward each other on the connecting shaft 24 in a direction of the wheel axle 16. Such a connection of the lock to the wheel is tight and rattle-free yet not deforming of the wheel rim 12. Also with the lock 10 secured to the rim 12, rotation of the wheel is limited and rolling motion of the bicycle restricted by horizontal extensions 42 from the main body portions 32 engaging the wheel supporting fork members 18. Further, to enable the lock 10 and hence the bicycle secured thereby to be fixed to a stationary object such as a post, the lock includes a cable 43. Opposite ends of the cable are secured by conventional means such as welding, to a base of the jaw 22 and to an end of the projection 42 from the jaw 20. Thus arranged, the cable 43 may be looped around the stationary object prior to a locking of the jaws on the rim to secure the bicycle in place.

As previously stated, the connecting shaft 24 supports the jaws 20 and 22 for relative movement toward each other and the rim 12. Preferably, the connecting shaft 24 is of circular cross section and of sufficient diameter and rigidity to resist deflection in response to bending moments imposed by the jaws 20 and 22 when in the aforesaid locked position. Such bending moments are developed by the nature of the impingement of the innermost peripheral edge 28*i* of the wheel rim 12 and sloping surfaces 34.

To accomodate the connecting shaft 24, coaxial holes 44 and 46 are formed in the jaws 20 and 22 respectively and the connecting shaft is positioned and rotatable therein. In addition, sufficient clearance is provided in hole 44 to accommodate relative axial movement between the jaw 20 and the connecting shaft 24 of the jaw 20 thus defining a movable jaw.

While the shaft 24 is rotatable in the hole 46, relative axial movement between the shaft and the jaw 22 is restricted, the jaw 22 thus defining an axially fixed jaw. Here, such a restriction is provided by an axial securing of an end of the connecting shaft to a turnable cylinder 48 of a lock 50. As shown in FIG. 3, the lock 50 is secured in a coaxial cavity 52 in an outer end of the horizontal extension 42 of the jaw 22. While various forms of locks may be included in the jaw 22 to limit axial movement of and provide means for selectively turning the shaft 24, a key-type is preferred with the turnable cylinder and hence the shaft 24 being turned in response to a turning of a key 54. In this respect, the lock 50 is of a conventional design, normally securing the shaft 24 in the rotational position shown in FIG. 2. Such a position defines a normally unlocked condition for the lock 10. Upon insertion of the key 54 into a keyway 56 of the lock 50, key slides 58 within the cylinder 48 are moved vertically to condition the lock 50 for a turning of the cylinder 48 and hence the shaft 24 in a clockwise direction (FIG. 2) by the key 54. To assist in such turning, a handle 60 is secured by a pin 62 to the key 54 as illustrated. As the key is turned in a clockwise direction, the cylinder 48 and shaft 24 assume the position shown in FIG. 3. Such defines a preselected rotational position for the shaft relative to the movable jaw 20 in which the movable jaw is forced toward the fixed jaw 22 to clamp tightly against the rim 12 and in which the movable jaw is secured against axial movement away from the fixed jaw. In the preselected rotational position, the key 54 may be removed from the lock 50 to leave the lock 10 in its locked condition. When it is desired to unlock the lock 10, the foregoing process is simply reversed to return the lock 10 to the condition illustrated in FIG. 2.

More particularly, while the jaws 20 and 22 are movable toward and from each other on the connecting shaft 24 when in the normal position illustrated in FIG. 2, the cooperative means 26 is designed (a) to force the movable jaw 20 toward the fixed jaw 22 to clamp tightly against the rim 12 as the shaft 24 is turned to the preselected rotational position, (b) to releasably lock the jaws against axial separation when the shaft is in the preselected rotational position, and (c) to release the jaws and permit axial separation when the shaft is returned to the normal rotational position.

From the foregoing description concerning the lock 50, it is of course understood that the rotational position of the shaft 24 relative to the jaws 20 and 22 is controllable in the illustrated form of my invention by the rotation or turning of the key 54. In connection with this, the cooperative means 26 may take various forms. For example, in the illustrated form of my invention and as most clearly shown in FIG. 3, the cooperative means comprises a plurality of closely spaced parallel arcuate channels 64, 65 and 66 and a cooperating locking pawl 68. In the orientation of the shaft shown in FIG. 2, that is the normally open condition for the lock 10, the channels are on the bottom side of the shaft. In the orientation of the shaft shown in FIGS. 3 and 4, that is the preselected rotational position of the shaft, the channels are on a top side of the shaft and resemble an arcuate portion of a relatively wide, ratchet-shaped screw thread.In that regard, the channels define acute angles with a longitudinal axis 69 of the shaft 24, and each includes a substantially vertical back or right side (FIGS. 3 and 5) and an upwardly and forwardly sloping left side (ramp).

The locking pawl 68 preferably comprises a relatively flat piece of metal located in a cavity 70 extending upwardly from the hole 44. As illustrated in FIG. 3, the pawl is held vertically in the cavity 70 by a V-shaped spring member 72 having as upper arm 74 bearing upon a base of a cavity 70a extending laterally from the cavity 70. An apex 76 of the spring member engages a right or back side of the cavity **70*a* and a lower arm 78 extends substantially parallel to the hole 44 and into an opening 80 in the pawl to continuously bear on a bottom of the opening (FIG. 4). Thus arranged, a top of the pawl bears against a vertical step or shoulder 79 in the cavity and the arm 78: (a) holds a tip end 82 of the pawl in the hole 44 to engage the curved outer surface of the shaft as it slides into the hole, (b) resists vertical movement of the pawl into the cavity and (c) urges the tip end 82 into a one of the acutely angled channels as the shaft 24 is turned to the preselected rotational position. In these regards and as illustrated in FIGS. 3 and 4, the tip end 82 of the pawl 68 is bent or slanted at the acute angle of the channels relative to a main body of the pawl and includes a slightly pointed and a concave bottom portion 83** following the contour of the arcuate bottom and sloping left side of the channels.

In addition to the channels and pawl, the cooperative means 26 includes a coil spring 84 and an adjusting screw 86. The coil spring 84 is located on the arm 78 of the V-shaped spring member 72 and is compressed between the apex 76 and a face of the pawl to continuously urge the pawl toward a left or front side of the cavity 70 defined by a recess 88 in a front face plate 90 secured to the movable jaw 20 by screws 92 (FIG. 2). The adjusting screw 86 extends through the face plate 88 and bears against a face of the pawl opposite the coil spring 84. In this manner the screw 86 opposes lateral movement of the pawl 68, presets the lateral position of the pawl in the cavity 70 along a longitudinal axis of the hole 44 and thereby determines which of the plurality of channels will receive the tip end 82 upon a turning of the shaft to the preselected rotational position. In this regard, the lock 10 is preset by turning the shaft 24 to the unlocked position shown in FIG. 2 and by moving the movable jaw 20 toward the fixed jaw 22 on the shaft until they engage the opposite sides of the rim 12. The adjusting screw 86 is then turned to laterally position the pawl 68 such that the tip end 82 is in line with the left most open end of one of the channels. Then a key-actuated turning of the shaft in a clockwise direction from the normal unlocked condition (FIG. 2) will cause the pawl to ride in and bear against the bottom and sides of the preselected channel. Continued turning of the shaft 24 toward the preselected rotational position will drive the pawl to the left and hence force the movable jaw 20 axially toward the fixed jaw 22 to tightly clamp the jaws against the opposite sides of the rim 12.

Having once preset the lock 10, it may be rapidly removed from and attached to the rim 12 as previously described simply by inserting the key 54 in the lock 50 and by turning the key and hence the shaft 24 between the unlocked condition illustrated in FIG. 2 and the locked condition shown in FIG. 3. In particular, and by way of summary, with the lock 10 in the condition shown in FIG. 2, the cable 43 is looped around a stationary object and the shaft 24 inserted in the hole 44 in the movable jaw 20. As the end of the shaft engages the tip end 82 of the pawl 68, the pawl is moved into the cavity 70 against the spring action of the member 72. The shaft 24 then slides into the hole 44 with the tip end 82 riding on the smooth surface of the shaft. When the fixed and movable jaws engage the opposite sides of the rim 12, the key 54 is turned to turn the shaft in a clockwise direction toward the preselected rotational position. As this occurs, the tip end 82 enters a channel, here 65, such that continued turning forces the pawl and hence the movable jaw to the left toward the fixed jaw to tightly clamp the jaws to the rim 12. An unlocking of the lock 10 simply requires a reversal of the foregoing and a turning of the key 54 and hence the shaft 24 in a counterclockwise direction. Alternatively, if desired, and by virtue of the ramp-shape of the left sides of the channels 64–66, in locking the bicycle lock the shaft 24 may be inserted into the hole 44 with the channels or an entrance portion thereof facing the pawl 68. In that case, the pawl 68 will ride into and out of the channels like in a one-way ratchet as the shaft is moved into the hole 44. Yet, when the pawl is in any of the channels, the vertical right side of the channel will prevent axial separation of the jaws and a further key-actuated turning of the shaft toward the preselected rotational position will drive the movable jaw toward the fixed jaw.

I claim:

1. A bicycle lock, comprising:

a pair of jaws for gripping opposite sides of a rim of a spoked wheel in a direction generally parallel to an axle of said wheel, at least one of said jaws supporting a projection for engaging a fork-like frame member supporting the said axle when said jaws are affixed in place on said rim to limit rotation of said wheel, said jaws including coaxial holes;

a connecting shaft turnable in said coaxial holes in said jaws, axially fixed relative to a fixed one of said jaws, and axially slidable in the hole in a movable one of said jaws; and cooperative means on said movable jaw and connecting shaft for (a) driving said movable jaw toward said fixed jaw and for (b) releasably locking said movable jaw against axial movement on said shaft away from said fixed jaw as said shaft is turned to a preselected rotational position relative to said movable jaw.

2. The lock of claim 1 wherein:

said cooperative means includes an arcuate channel on a one of said shaft and movable jaw in the hole therein and forming an acute angle with a longitudinal axis of said shaft and a pawl extending from another of said shaft and movable jaw in the hole therein to ride in said channel only when said shaft is turned to said preselected rotational position to urge said movable jaw axially on said shaft toward said fixed jaw.

3. The lock of claim 2 further including:

a key-actuated lock in said fixed jaw and including a keyturnable cylinder fixed to said shaft to produce a turning thereof between a normally unlocked rotational position wherein said shaft freely slides into and out of said hole in said movable jaw and said preselected rotational position wherein said movable jaw is driven by said cooperative means toward said fixed jaw and wherein said movable jaw is axially fixed relative to said fixed jaw.

4. The lock of claim 2 wherein:

said channel is on said shaft;

said movable jaw includes a cavity extending from said hole therein for vertically receiving said pawl with a tip thereof extending into said hole therein; and said cooperative means further includes a generally V-shaped spring member having one arm bearing on a base of said cavity and another arm engaging said pawl to vertically secure it in said cavity with said tip extending into said hole and to oppose vertical movement of said pawl into said cavity.

5. The lock of claim 4 wherein said tip of said pawl is slanted and curved to follow the angle and contour of said channel.

6. The lock of claim 4 wherein said cooperative means further includes:

a coil spring on said other arm of said V-shaped spring member and engaging a face of said pawl to continuously urge said pawl toward a front side of said cavity; and screw means turnable in said movable jaw and engaging an opposite face of said pawl to oppose movement of said pawl toward said front side and to preset the position of said pawl in said cavity along a longitudinal axis of said hole.

7. The lock of claim 6 wherein said shaft carries a plurality of adjacent channels and wherein adjustment of said screw means presets the channel into which said pawl will ride upon a turning of said shaft to clamp the lock on said rim.

8. The lock of claim 5 wherein said shaft carries a plurality of similar adjacent arcuate channels each including opposing substantially vertical and ramp-shaped sides for combining with said pawl to define a one-way ratchet means.

* * * * *